US005685188A

United States Patent [19]

Rehag et al.

[11] Patent Number: 5,685,188

[45] Date of Patent: Nov. 11, 1997

[54] UNIVERSAL MILL STAND FOR FORMING TUBES

[75] Inventors: Klaus Rehag, deceased, late of Mönchengladbach, by Liselotte Rehag, heir; Bernhard Heimann, Moers, both of Germany

[73] Assignee: Mannesmann Aktiengesellschaft, Düsseldorf, Germany

[21] Appl. No.: 575,759

[22] Filed: Dec. 22, 1995

[30] Foreign Application Priority Data

Dec. 23, 1994 [DE] Germany ..... 44 47 397.4

[51] Int. Cl.[6] ..... B21B 31/07

[52] U.S. Cl. ..... 72/239; 72/238; 72/225

[58] Field of Search ..... 72/225, 238, 239, 72/237, 247, 248

[56] References Cited

U.S. PATENT DOCUMENTS 5,497,644 3/1996 Poloni et al. ..... 72/239

*Primary Examiner*—Lowell A. Larson
*Assistant Examiner*—Ed Tolan
*Attorney, Agent, or Firm*—Cohen, Pontani, Lieberman & Pavane

[57] ABSTRACT

A universal mill stand for continuously forming tubes, especially in tube welding units, into round or profiled tubes. The mill stand has a housing from which the complete universal assemblies can be removed and exchanged for producing round tubes or for producing profiled tubes.

4 Claims, 6 Drawing Sheets

UNIVERSAL MILL STAND FOR FORMING TUBES

BACKGROUND OF THE INVENTION

1. Field of the Invention

The invention relates to a universal mill stand for continuously forming tubes, especially in tube welding units, into round or profile tubes, with the help of rollers that are adjustably arranged in pairs across from one another on a common plane vertical relative to the longitudinal axis of the tub, and the accordingly formed grooves of which surround the tube.

2. Description of the Prior Art

In the contour forming section of welding units, a plurality of stands are used that are located one behind the other. Each of the stands has four rollers arranged on a single plane. In keeping with their roll pass design, these stands give the tube a round or profiled (rectangular or square) cross-sectional shape. The universal mill stands for forming round tubes are equipped with round-grooved rollers, which are precisely adjusted to the tube shape desired in each particular case. This means that in order to form any other tube shape, new rollers must be placed into the stand, which entails considerable changeover work.

Universal stands for producing profiled tubes, e.g., square tubes, are known, in which the rollers, in order to permit adjustment of the tube cross-sectional shape of the tube, are arranged to be movable radially and axially on carriages. In this way various cross-sectional shapes can be attained by setting the rollers in an internested fashion. However, these previously known universal assemblies are suitable only for the production of profiles. Furthermore, the expense of adjusting these known universal assemblies is considerable.

In addition, EP 0582562 teaches that adjustments to different tube sizes and tube shapes can be made by mounting each of the rollers, which are radially adjustable relative to the tube, in a pivotally-adjustable fashion around a pivot axis that is parallel to the tube axis. However, this complicated measure only permits a very limited adjustment of the final tube shape. Additionally, the shaping of circular tubes is not possible with an arrangement of this type.

SUMMARY OF THE INVENTION

Starting from the described prior art and the problems and disadvantages mentioned above, the object of the present invention is to provide a universal mill stand in which both round and profiled tubes having high shape accuracy can be economically produced with low construction expense and high reliability.

Pursuant to this object, one aspect of the present invention resides in a universal stand from which the complete universal assemblies are removable and alternatively exchangeable for different universal assemblies to selectively produce round tubes or profiled tubes.

For the first time, the present invention makes it possible, in the contour forming section of a tube welding unit, to alternately use universal assemblies for producing round tubes and universal assemblies for producing profiled tubes in a single stand. In this way the expensive conversion of the stands for different tube cross-sectional shapes is significantly reduced. Additionally, exchanging the complete universal assemblies reduces the downtime of the tube welding unit so substantially that a markedly higher output is achieved.

In an especially advantageous further embodiment of the present invention, the chocks which hold the rollers of each universal assembly for producing profiled tubes are designed in a boxed-shaped fashion. Each chock is guided in a movable fashion to the adjacent chocks of the same universal assembly parallel and at a right angle to the axis of the roller which it holds.

Starting from a known universal stand, such as the described CTA calibrating element of the Voest-Alpine Company, a universal assembly is simplified and optimized so as to permit quick and easy exchange with an assembly that produces round tubes, and also to allow simple, accurate and constructively inexpensive adjustment of the universal assembly to different cross-sectional shapes during the production of profiled tubes. The guides for moving the chocks and thus the rollers of the universal assembly that produces profiled tubes are no longer located within the stands, but rather on the very chocks that hold the rollers. The arrangement of the guides permits an exact adjustment of the rollers by means of the adjustment elements resting on the stand, which remain on the stand when the universal assembly is removed and thus make removal simpler. Furthermore, the universal assembly is designed compactly and in a clearly understandable fashion.

In a further embodiment of the invention, the guides for moving the chocks are located on the side uprights of the chocks and are designed as slide pieces and slide grooves which accommodate the slide pieces. The guides for the adjacent chocks of a universal assembly run vertical to one another. This creates an adjustment mechanism that is stable and can be accurately guided, which ensures precise accuracy of shape in the produced tubes, along with short adjustment times and the advantageous removal and installation of the universal assembly mentioned previously.

To exchange the universal assemblies, the assemblies are moved out of the universal roll stand laterally. For this purpose, the removal-side horizontal screw-down device can be removed at a right angle from the area of the housing window on a sliding guide. Thus, the screw-down device is removed only on the removal side of the stand, while the sliding guide is located on the stand and the horizontal screw-down device therefore remains on the stand, albeit moved to the side.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
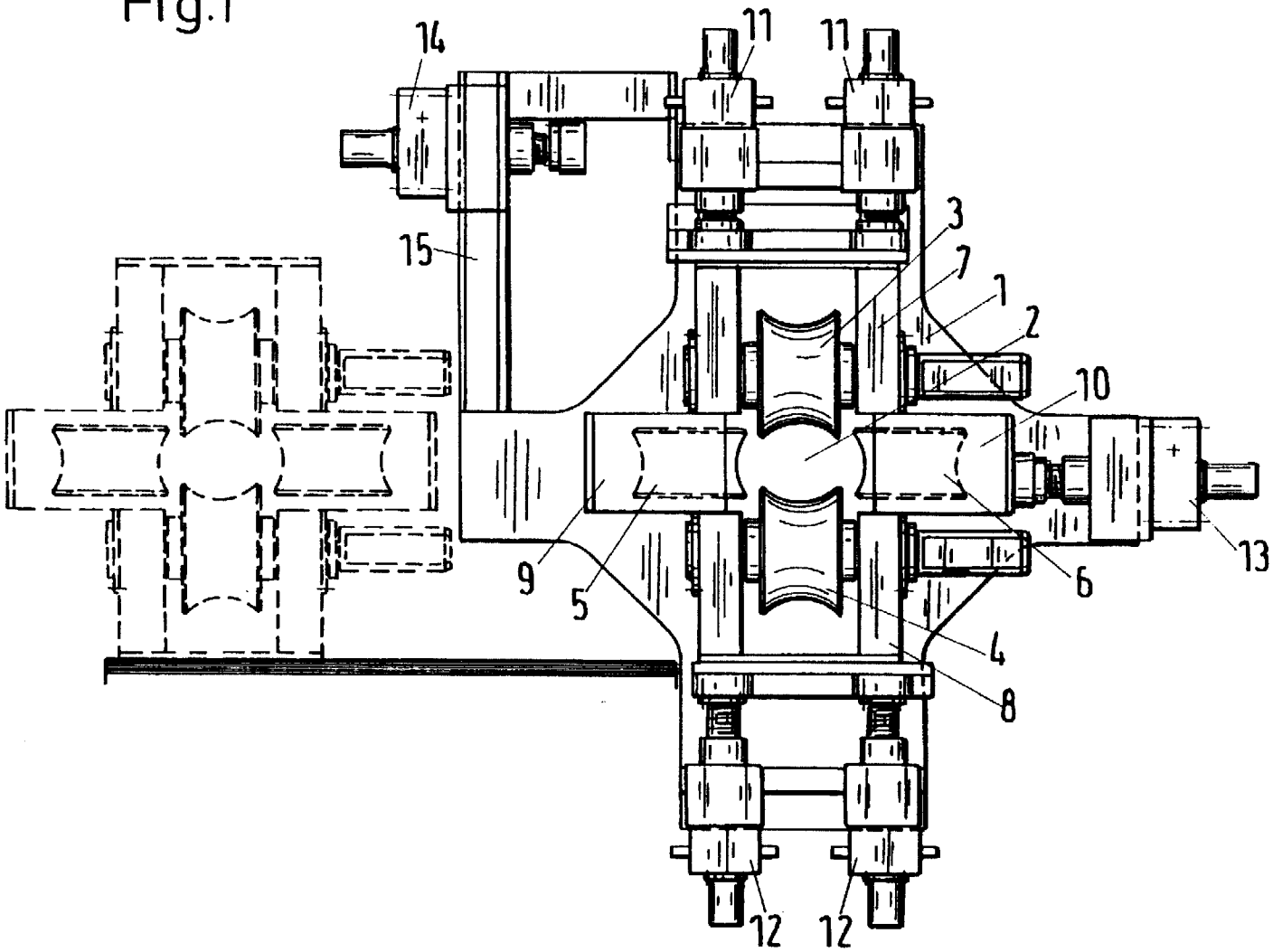
FIG. 1 illustrates a universal mill stand according to the invention for producing round tubes, in the removal or post-removal position.

In FIG. 1, the housing of the universal mill stand, which is suitable for continuously forming round tubes as well as profiled tubes, is indicated by 1. In the housing 1, the universal assembly 2 can be seen. The universal assembly 2 consists of an upper horizontal roller 3, a lower horizontal roller 4, and two vertical rollers 5, 6. The rollers 3–6 are mounted in chocks 7–10. The upper chock 7 holds the upper roller 3, the lower chock 8 holds the lower roller 4, and the chocks 9, 10 hold the vertical rollers.

To screw-down the upper and lower horizontal rollers 3,4, an upper screw-down device 11 and a lower screw-down device 12 are provided, which, in a conventional manner, carry out the adjustment relative to the line of rolling and/or the screw-down of the rollers relative to one another. To adjust the vertical rollers 5, 6, a hydraulic screw-down device 13 is provided for roller 6, and a hydraulic screw-down device 14 is provided for roller 5, which in FIG. 1 is moved upward on a sliding guide 15 attached to the housing 1, so that the complete universal assembly with the chocks 7, 8, 9 and 10 and the rollers 3, 4, 5 and 6 can be moved out of the housing window into the position next to the housing 1 shown by the broken line. In the operating position, the hydraulic screw-down device 14 is moved downward and acts, like the screw-down device 13, upon the chock 9 of the vertical roller 5.

FIG. 1 also shows that in order to remove the universal assembly, the chocks are moved apart, i.e., the chocks 9, 10 of the vertical rollers are set down on the chock 8 of the lower horizontal roller, and the chock 7 of the upper horizontal roller 3 is set down on the chocks 9, 10 of the vertical rollers.

Figure 2:
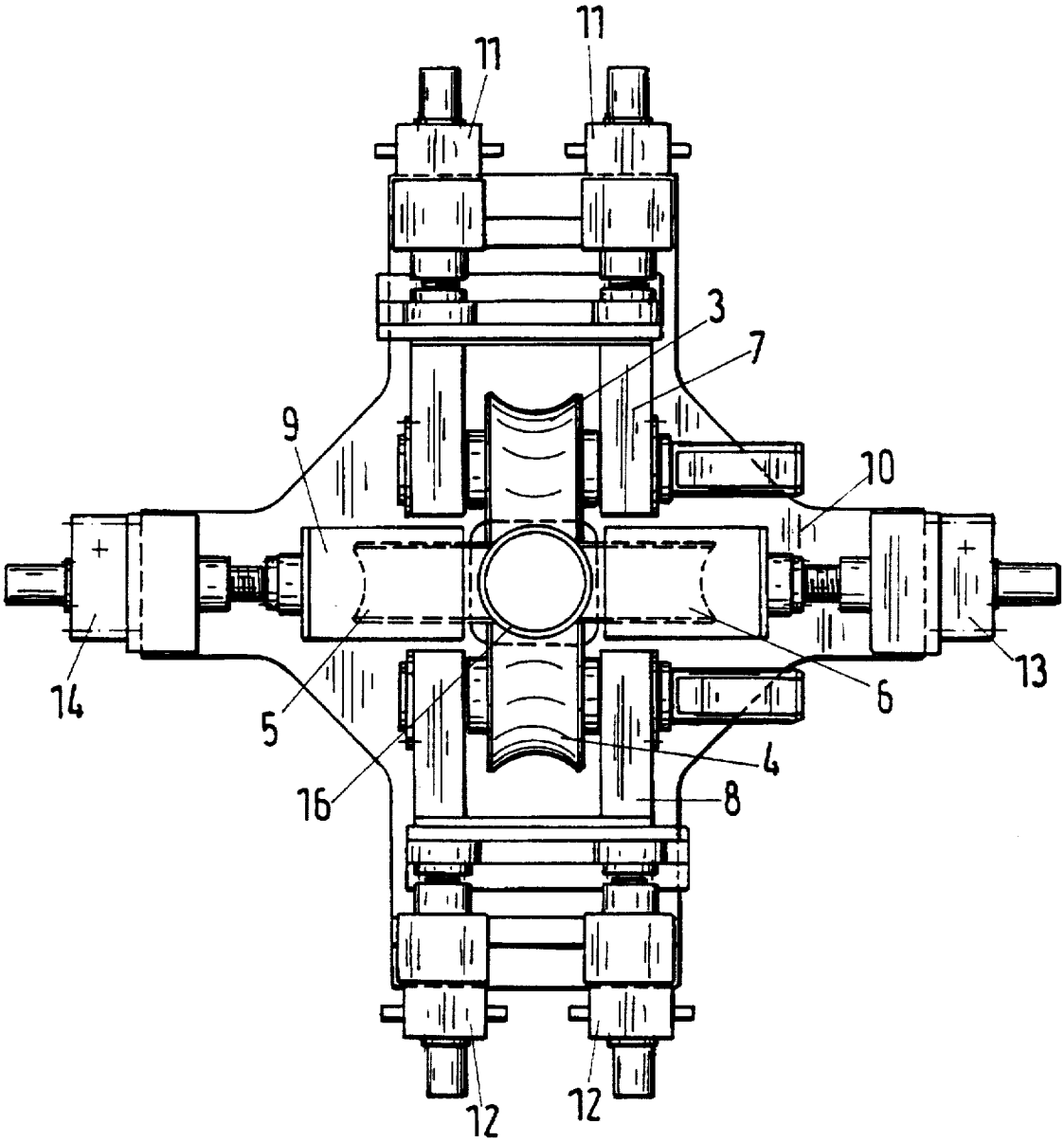
FIG. 2 shows the stand of FIG. 1, in an operating position.

In the operating position, shown in FIG. 2, the chocks 7, 8, 9 and 10 are centered relative to the rolling axis so that the groove of the rollers 3–6 surrounds the tube 16 on all sides and gauges the tube. In FIG. 2, numbering is the same as in FIG. 1.

Figure 3:
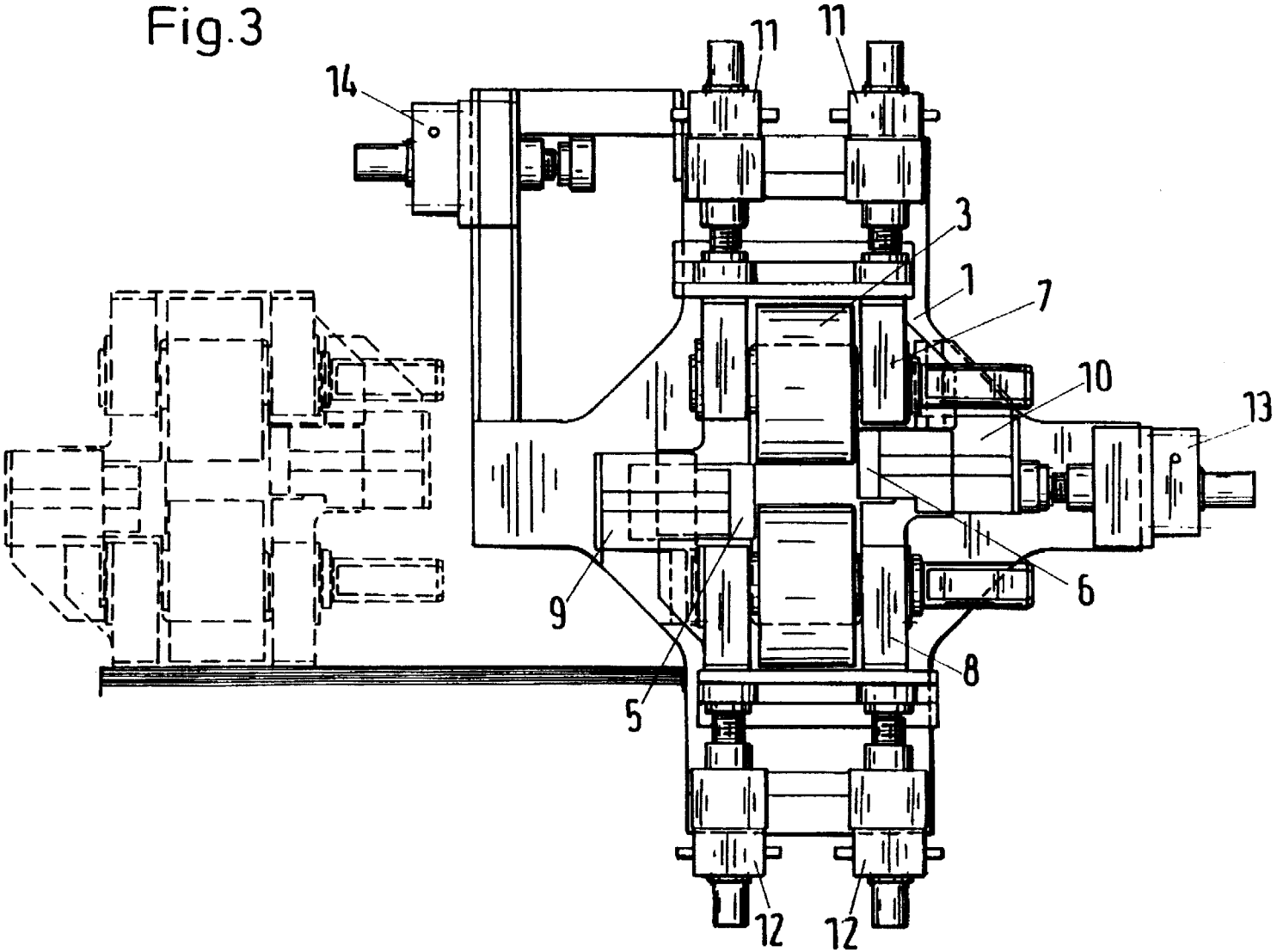
FIG. 3 illustrates a universal mill stand according to the invention for producing profiled tubes, in the removal or post-removal position.

In FIG. 3, a universal assembly for producing profiled tubes is used in the same housing 1 of the universal mill stand shown in FIG. 1. For the sake of simplicity, numbering is once again the same. Using the screw-down devices 11, 12, 13 and 14, the chocks 7, 8, 9 and 10, which are now designed suitably for the cylindrical rollers 3–6, are set to the desired groove, as will be described below. With this universal assembly, too, the chocks are moved apart from one another for removal, as described in reference to FIG. 1. When the hydraulic screw-down device 14 is moved out of the area of the housing 1, the universal assembly can be moved out completely into the position shown in broken lines.

Figure 4:
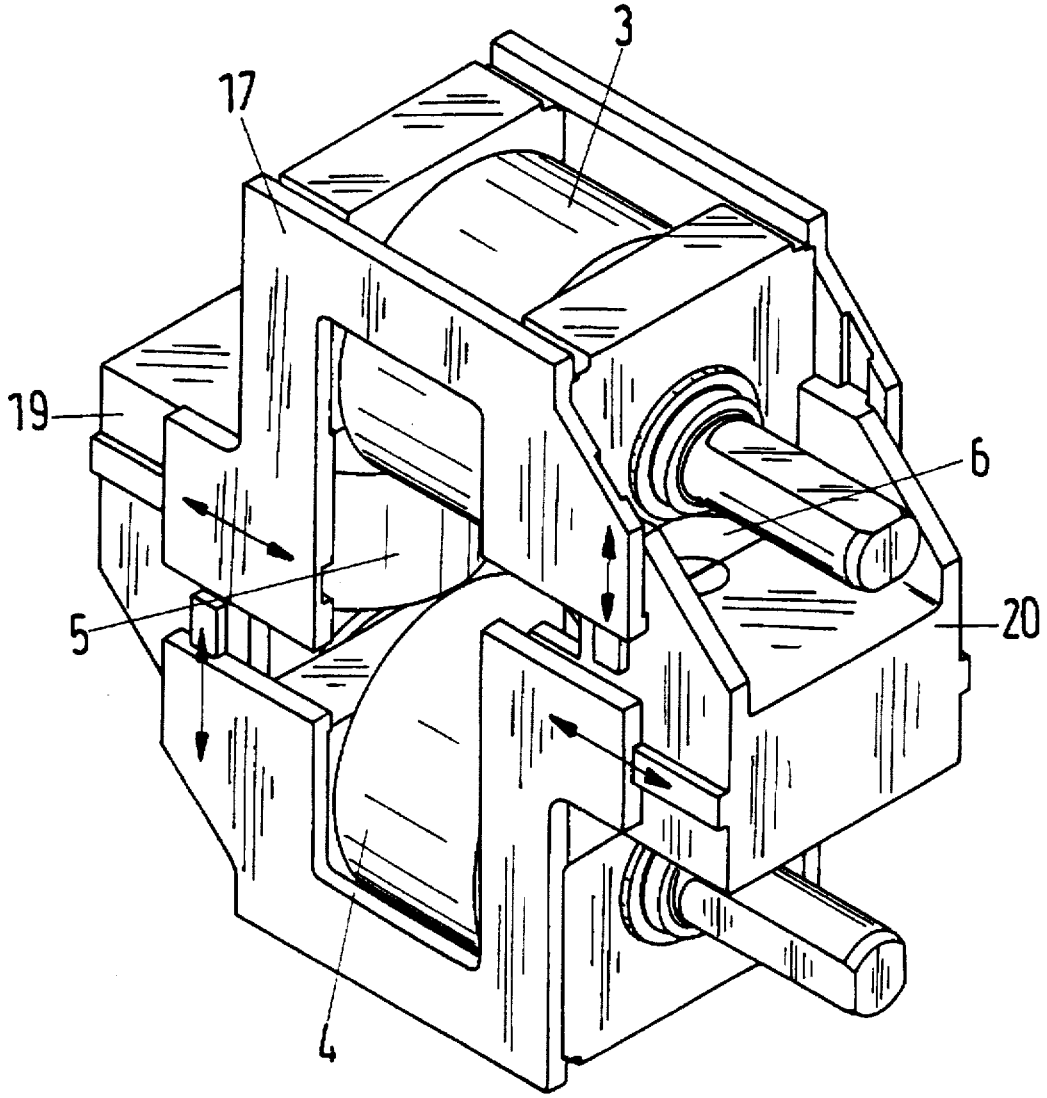
FIG. 4 shows the universal assembly removed from the universal mill stand, in perspective.

FIG. 4 shows, in perspective, an embodiment of a universal assembly for producing profiled tubes, which assembly consists of four chocks that hold the rollers 3–6 and are designed in a box-shaped fashion and are internested within one another in the installed position. The chock 17 holds the upper horizontal roller 3, and the chock 18 holds the lower horizontal roller 4. The chocks 19, 20 respectively hold the vertical rollers 5, 6.

Figure 5:
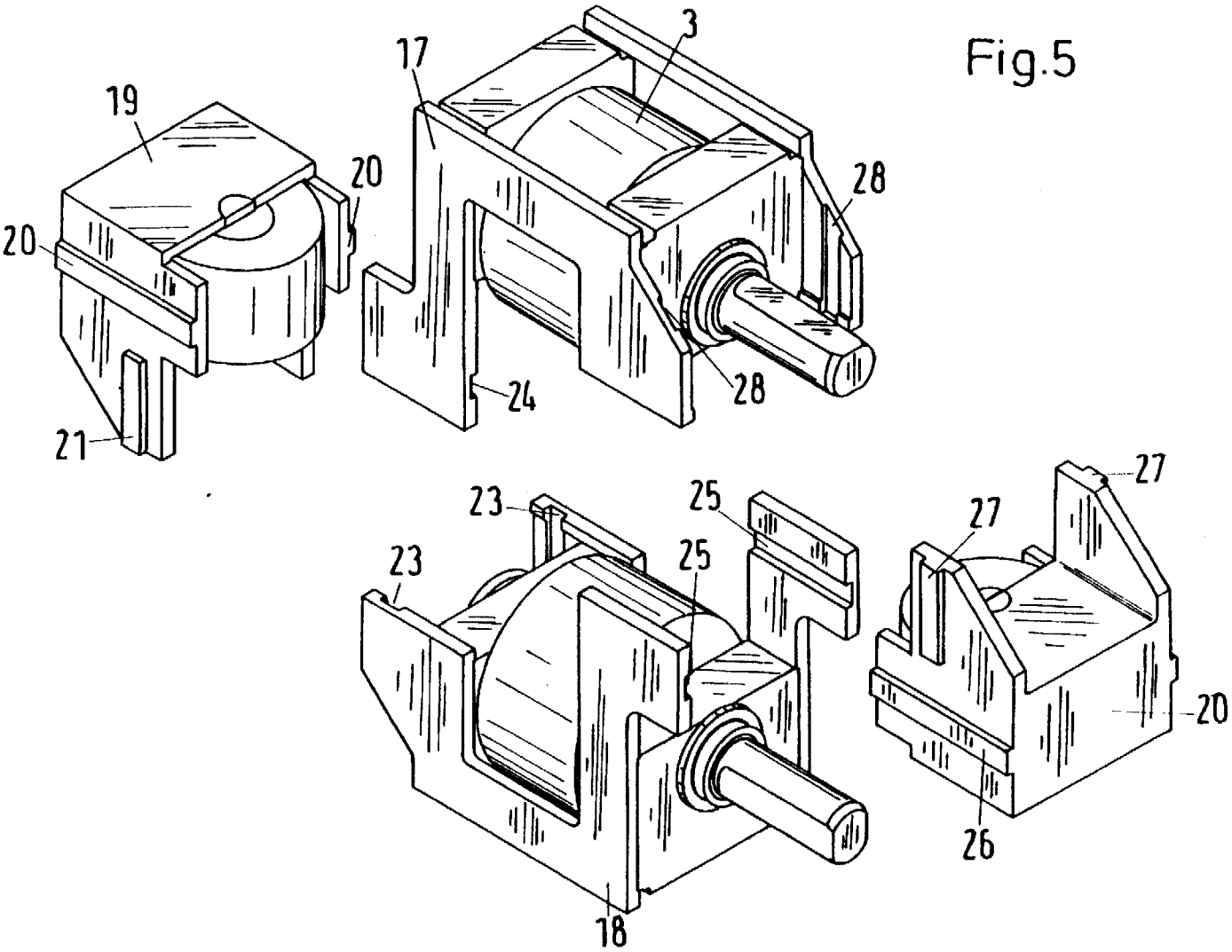
FIG. 5 shows the universal assembly as in FIG. 4, with individual chocks.

For the sake of clarity, FIG. 5 shows the box-shaped chocks 17–20 with the rollers 3–6 in a dismantled state, as in an exploded view. This makes it clear that each chock is provided on the inner or outer flanks with guides for the respective adjacent chocks. It can thus be seen that the chuck 19 has the guide pieces 20, 21 on two opposite flanks. In the assembled state, the guide piece 21 matches a correspondingly designed groove 23 on the inner flank of the chock 18 and the piece 20 fits into the correspondingly designed groove 24 on the chock 17 for the upper horizontal roller 3. The grooves 25 correspond to the guide pieces 26 on the chock 20, and the guide pieces 27 on the chock 20 fit into the grooves 28 on the chock 17.

Figure 6:
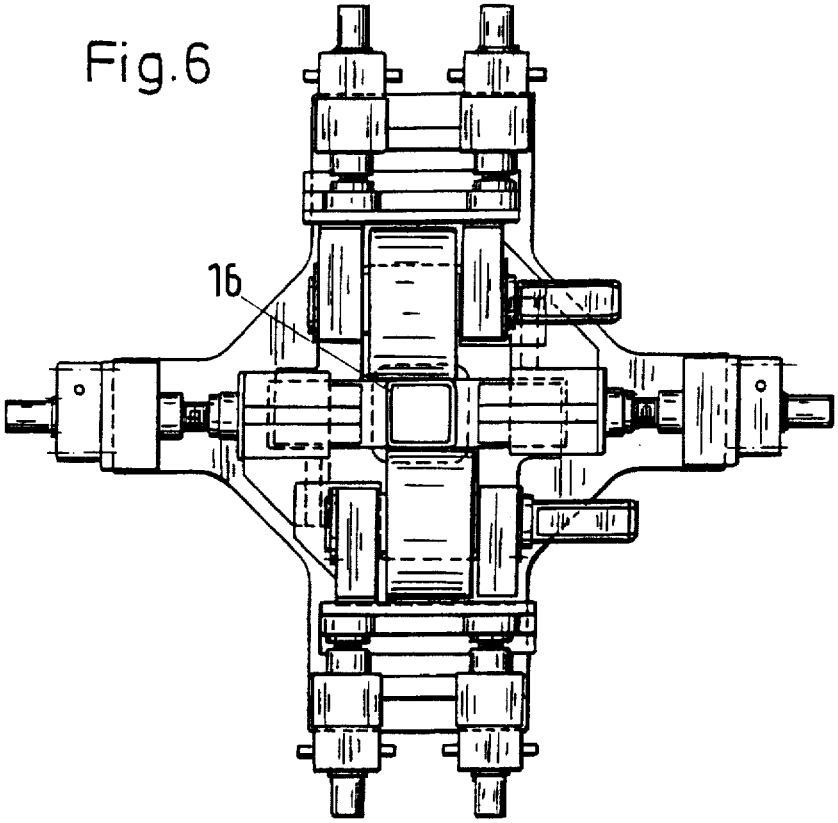
FIGS. 6 and 7 illustrate two universal mill stands according to the invention for producing profiled tubes of different cross-sections.
Figure 7:
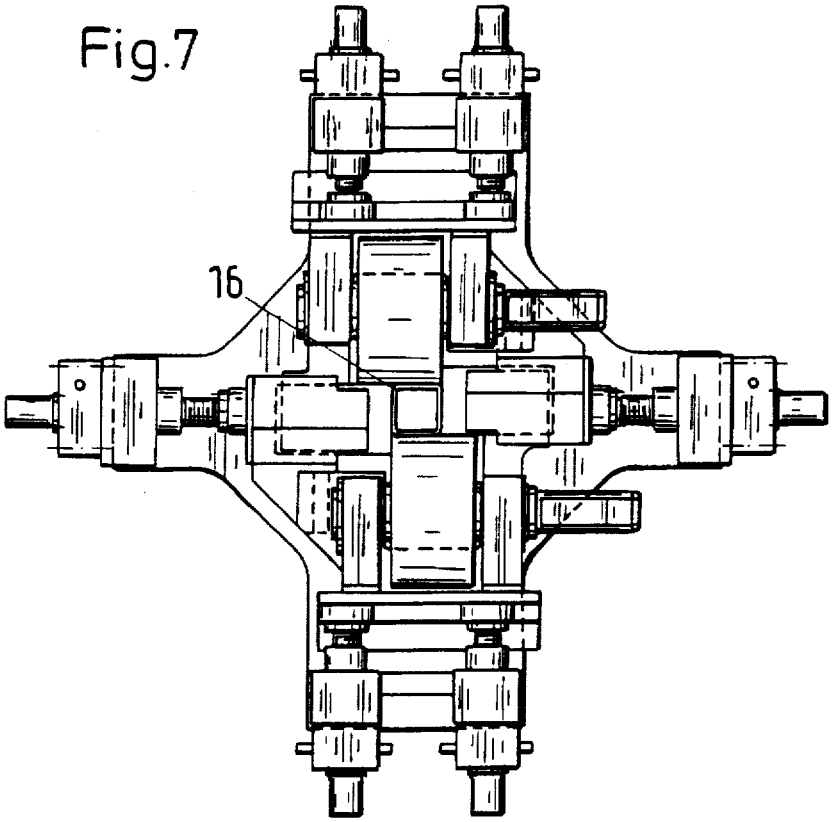

By guiding the chocks 17, 18, 19, 20 on the respectively adjacent chocks in this manner, a stable and compact arrangement of the chocks relative to one another is attained. At the same time, an accurate axial and simultaneously parallel movement of the rollers 3–6 relative to one another for the purpose of setting the desired cross-sectional shapes is ensured. FIGS. 6 and 7 show two different movement settings of the rollers 3–6. The tubes 16 can be seen to have obtained, by virtue of the axial movement of the rollers 3–6, different cross-sectional areas.

The advantage of the present invention resides, first of all, in the interchangeability of the universal assemblies for round and profiled tubes and, secondly, in the advantageous movement arrangement of the chocks of the universal assembly for producing profiled tubes, so that, with an extremely simple construction and thus with economic feasibility tubes with excellent properties and characteristics can be produced.

The invention is not limited by the embodiments described above which are presented as examples only but can be modified in various ways within the scope of protection defined by the appended patent claims.

We claim:

1. A universal mill stand for continuously forming tubes along a longitudinal axis, comprising:

a housing;

complete universal assemblies removably and interchangeably mounted on the housing, each of the assemblies having two pairs of rollers, the rollers of each pair being arranged across from one another on a common plane vertical to the longitudinal axis, one of the universal assemblies having rollers for producing round tubes and another of the universal assemblies having rollers for producing profiled tubes, the universal assembly for producing profiled tubes including chocks in which the rollers are held, each one of the chocks holding one of the rollers, the chocks being configured to form a box-like construction, each of the chocks being mounted on the universal assembly so as to be moveable parallel and at a right angle to the axis of the roller held by the chock;

means for moving the chocks; and, guide means for guiding movement of the chocks, the guide means including slide members and slide grooves which accommodate the slide members, the slide members and slide grooves being arranged on sides of the chocks, the slide members for adjacent chocks of the universal assembly being arranged to run perpendicular to one another.

2. A universal mill stand according to claim 1, wherein the chock moving means includes a separate screw-down device for each chock.

3. A universal mill stand according to claim 1, wherein the slide members are provided on a first opposing pair of the chocks and the slide grooves are correspondingly provided on a second opposing pair of the chocks.

4. A universal mill stand according to claim 1, wherein the universal assemblies are configured to be moveable laterally out of one side of the housing in a movement direction, and further comprising a slide guide provided on the one side of the housing at a right angle to the movement direction, the moving means of the chock on the one side being movable along the slide guide at a right angle to the movement direction of the assemblies.

* * * * *